US007240644B1

(12) United States Patent
Slike et al.

(10) Patent No.: US 7,240,644 B1
(45) Date of Patent: Jul. 10, 2007

(54) INTERNAL COMBUSTION ENGINE WITH CYLINDER HEAD HAVING DIRECTED COOLING

(75) Inventors: Jody Michael Slike, Farmington Hills, MI (US); Jeffrey John Lock, Dearborn, MI (US); Raymond Gregory Puhl, Dearborn Hts., MI (US); Paul Thomas Reinhart, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/422,655

(22) Filed: Jun. 7, 2006

(51) Int. Cl.
*F02F 1/38* (2006.01)
*F02F 1/40* (2006.01)

(52) U.S. Cl. ..... 123/41.82 R; 123/41.72

(58) Field of Classification Search ..... 123/41.82 R, 123/41.41, 41.76, 41.77, 41.85, 41.72
See application file for complete search history.

(56) References Cited

U.S. PATENT DOCUMENTS 4,530,323 A * 7/1985 Wakasa ..... 123/41.77
4,660,527 A * 4/1987 Tanaka et al. ..... 123/41.82 R
5,379,729 A * 1/1995 Yonezwa et al. ..... 123/41.82 R
5,799,627 A * 9/1998 Dohn et al. ..... 123/41.82 R
6,363,893 B1 * 4/2002 Xin et al. ..... 123/41.82 R
6,681,727 B2 * 1/2004 Krenn ..... 123/41.82 R
7,044,089 B2 * 5/2006 Yamada ..... 123/41.82 R
2005/0036706 A1 * 2/2005 Yamamoto ..... 123/41.74

* cited by examiner

*Primary Examiner*—Stephen K. Cronin
*Assistant Examiner*—Ka Chun Leung
(74) *Attorney, Agent, or Firm*—Gary Smith; Artz & Artz, P.C.

(57) ABSTRACT

An internal combustion engine cylinder head unit includes a number of gas flow ports extending upwardly from a fire deck. A common coolant passage extends between adjacent ones of the gas flow ports. A first coolant flow director includes a flow splitter extending downwardly into the common coolant passage so as to cause a coolant flow within the common coolant passage to remain attached upon an upper surface of the fire deck between adjacent ports. A second coolant passage runs about a radially outboard portion of the cylinder head unit, and flow in this passage is directed by a truncated bulk flow displacer extending from a rear wall of the second coolant flow passage. The second flow director causes the impingement of coolant upon both an upper surface of the fire deck and upon an outboard portion of at least one of the cylinder ports.

10 Claims, 3 Drawing Sheets

INTERNAL COMBUSTION ENGINE WITH CYLINDER HEAD HAVING DIRECTED COOLING

BACKGROUND OF THE INVENTION

1. Field of the Invention

The present invention relates to an internal combustion engine with novel cooling passages located within the cylinder head.

2. Disclosure Information

Liquid-cooled internal combustion engines have been in continuous use for more than a century. In the beginning, cooling systems for single cylinder engines relied upon a reservoir incorporated in the cylinder of the engine to flood an external portion of the cylinder with water, which was allowed to boil off. Later cooling system designs, although using radiators, employed steam generated within the engine to force the coolant through various passages. Finally, pumped cooling came to the fore.

The demands placed on engine cooling systems, defined to include the various cooling passages within the cylinder block and cylinder head of an engine, are not too great in the case of engines which are operated at low specific output. However, engines which are operated at high levels of specific output require large amounts of fuel, and therefore place heavy demands on their cooling systems. Moreover, cooling system design is critical with respect to particular areas of an engine's cylinder head, such as the bridge area extending between adjacent valves. This bridge area is particularly prone to thermal stress and cylinder head fire deck cracking, in the case of either two-valve engines with a single intake and exhaust in each cylinder head unit, or with multiple valve engines having, for example, two intake valves and a single exhaust valve, or even engines with two or more intake valves and two or more exhaust valves.

As used herein, the term "cylinder head unit" means a specific portion of a cylinder head having a single combustion chamber dedicated to a single engine cylinder. Thus, a cylinder head for a four-cylinder inline engine would have four cylinder head units. Following this convention, a cylinder head for a V-6 engine would have three cylinder head units.

A cylinder head having directed cooling according to the present invention permits operation at high specific output by applying the circulating coolant to the areas of the cylinder head which are either subject to the greatest heat flux, measured in terms of units of heat energy per unit of surface area, or which are prone to damage, such as the previously mentioned bridge area extending between adjacent valves in a given cylinder head unit. As a result, the present cylinder head is said to have "directed" cooling.

SUMMARY OF THE INVENTION

An internal combustion engine cylinder head includes a number of intake ports extending upwardly from a fire deck and a number of partially conjoined exhaust ports extending upwardly from the fire deck. A common coolant passage extends between the exhaust ports. A first coolant flow director extends into the common coolant passage, so as to cause coolant flowing within the common coolant passage to remain attached upon an upper surface of the fire deck between the exhaust ports. The first coolant flow director further causes coolant to flow about an outer surface of each of the exhaust ports.

According to another aspect of the present invention, a first coolant flow director includes a flow splitter depending from an upper wall of the common coolant passage. The flow splitter may divide at least a portion of the common coolant passage into three sub-passages.

According to another aspect of the present invention, an internal combustion engine may further include a second coolant passage extending about a radially outward portion of the cylinder head unit. The second coolant passage preferably includes a second coolant flow director extending into the second coolant passage from a rear wall of the second coolant passage so as to cause coolant flowing within the second coolant passage to impinge upon an upper surface of the fire deck, as well as upon at least an outboard portion of one of the exhaust ports. In this embodiment, the second coolant flow director preferably comprises a truncated bulk flow displacer.

In general, the present invention is applicable to any cylinder head unit including a number of gas flow ports extending upwardly from a fire deck, where a common flow passage extends between adjacent ports. The ports may include either two intake ports, two exhaust ports, or an intake port and an exhaust port.

It is an advantage of a cylinder head unit according to the present invention that the durability of the cylinder head is enhanced by the capability to cool the bridge area between adjacent valves in an enhanced manner.

It is a further advantage of a cylinder head according to the present invention that an engine with this invention should have a lower octane requirement because of the likelihood that the cylinder head's combustion chamber will have a more uniform temperature distribution.

It is yet another advantage according to the present invention that the ability to control and manage cylinder head heat distribution will improve fuel economy of the engine by allowing optimal spark timing.

Other advantages, as well as features and objects of the present invention will become apparent to the reader of this specification.

DETAILED DESCRIPTION OF THE PREFERRED EMBODIMENTS

Figure 1:
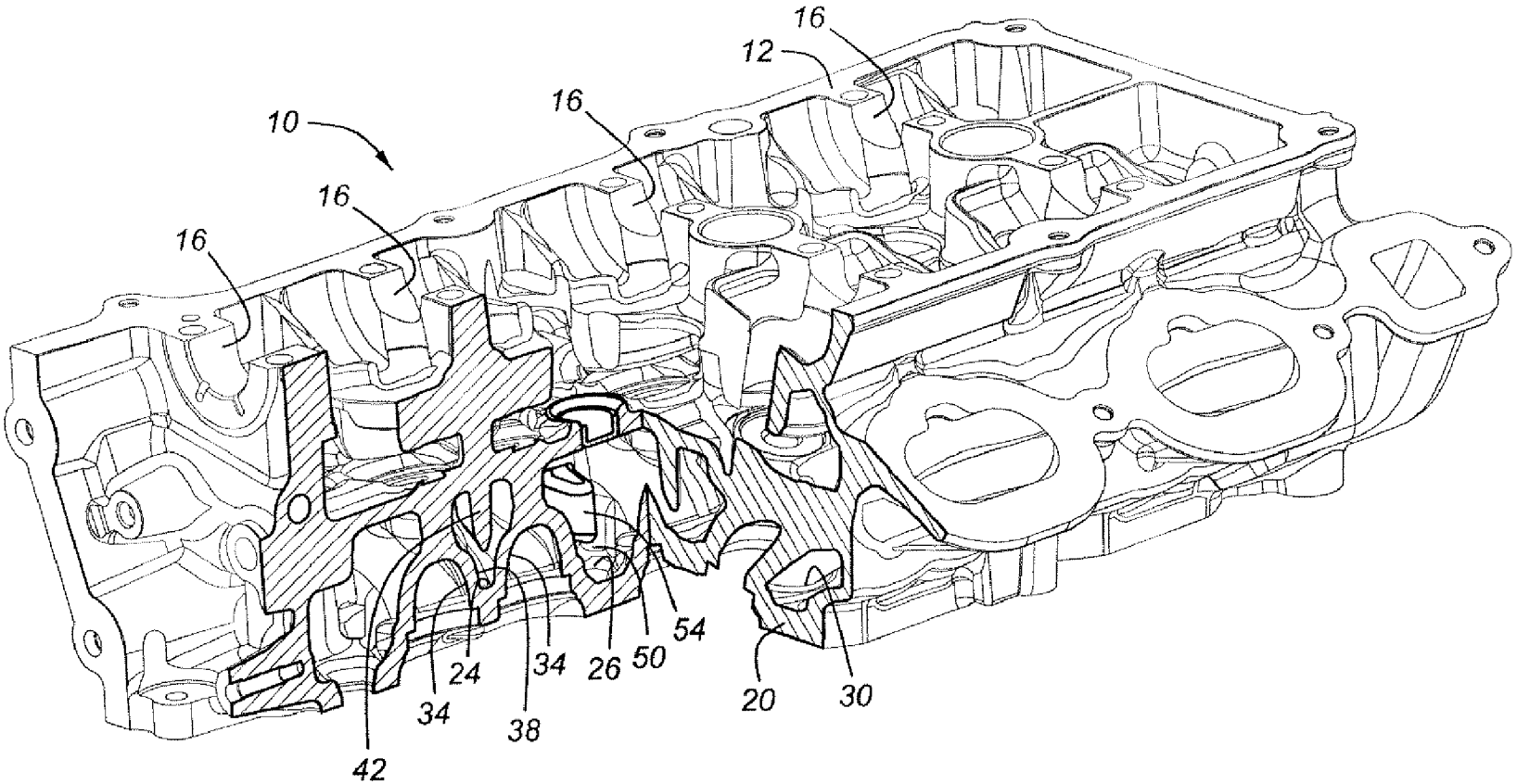
FIG. 1 is a perspective view of a cylinder head according to the present invention.

As shown in FIG. 1, cylinder head 10 includes casting 12, which has a number of cam bearing bulkheads 16 formed therein. An overhead camshaft (not shown) may be secured to cylinder head 10 by affixing the camshaft into cam bearing bulkheads 16 with suitable caps. Cylinder head 10 has a fire deck, 20, which serves as a mounting surface for cylinder head 10 upon a cylinder block (not shown). The present cooling system is intended to remove heat from upper surfaces of fire deck 20. Specifically, upper surface 24 of fire deck 20, which extends between adjacent exhaust ports 34, is cooled by the direct impingement of coolant upon its surface. If desired, a similar cooling flow could be established between adjacent ones of the intake ports 30, with one of ports 30 being shown in FIGS. 1 and 2.

Figure 2:
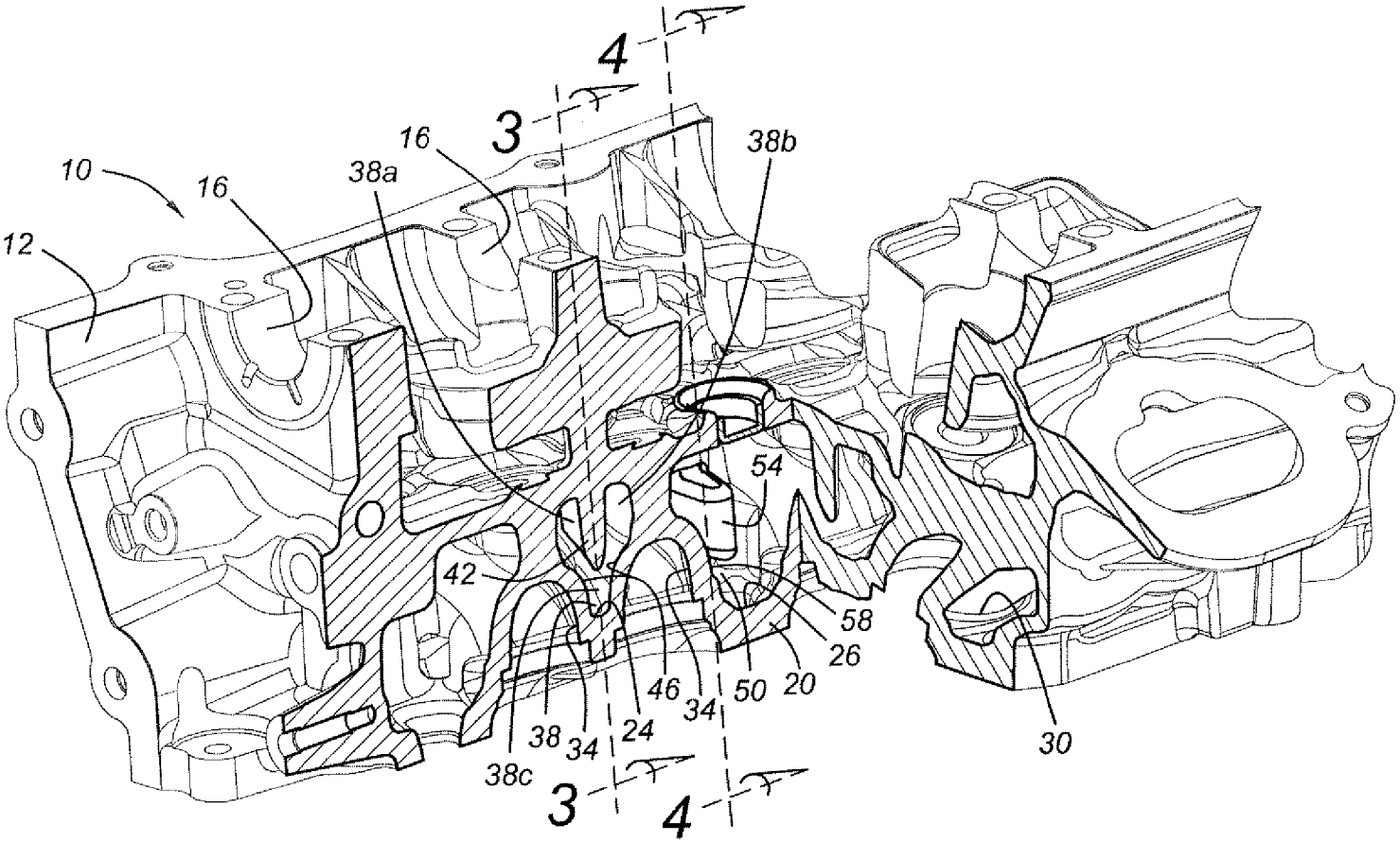
FIG. 2 is an enlarged view of a portion of a cylinder head according to the present invention which is cut away in the manner of FIG. 1.

Those skilled in the art will appreciate in view of this disclosure that ports 34 are illustrative of not only two exhaust ports, but alternatively depict two intake ports, or a single intake port and a single exhaust port. In any event, common coolant passage 38 extends between exhaust ports 34, which are partially conjoined. In other words, exhaust ports 34 are attached very closely to one another at the section line 3-3. First coolant flow director 42 is shown in FIGS. 1 and 2, as depending from an upper wall of passage 38. This upper wall is shown at 38*d* in FIG. 3. First coolant flow director 42 divides common coolant passage 38 into three sub-passages 38*a*, 38*b* and 38*c*. These are shown with particularity in FIG. 2.

First coolant flow director 42 causes the coolant flow within common coolant passage 38 to remain attached to upper surface 24 of fire deck 20. This is shown with particularity in FIG. 3. Flow director 42 also causes coolant to impinge upon the outer surfaces of exhaust ports 34 which are shown in FIG. 2 as forming part of passage 38. Without the intercession of first coolant flow director 42, coolant would be free to flow down the middle of passage 38 without remaining attached to surface 24 for any significant length. Moreover, the coolant would be free to avoid the wall surfaces of ports 34, as well. As the flow is directed to exhaust port outer surfaces 34, a recirculation results which further promotes and preserves attachment of the flow to surface 24.

Figure 3:
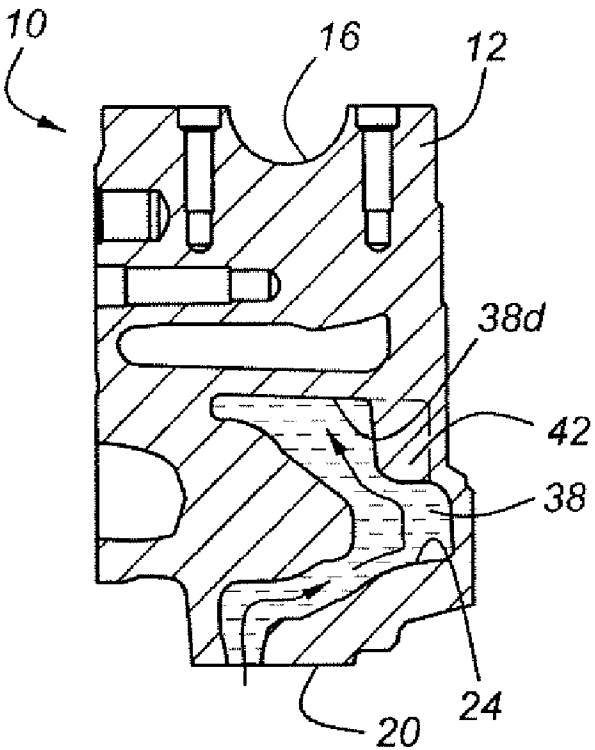
FIG. 3 is a sectional view of a portion of the cylinder head of FIG. 2, taken along the line 3-3 of FIG. 2.

FIG. 3 illustrates first coolant flow director 42 and its activity. As shown by the flow arrows, flow is directed onto upper surface 24 of fire deck 20. If flow director 42 were not present in passage 38, the flow would not be directed with any specificity onto surface 24 of fire deck 20.

Figure 4:
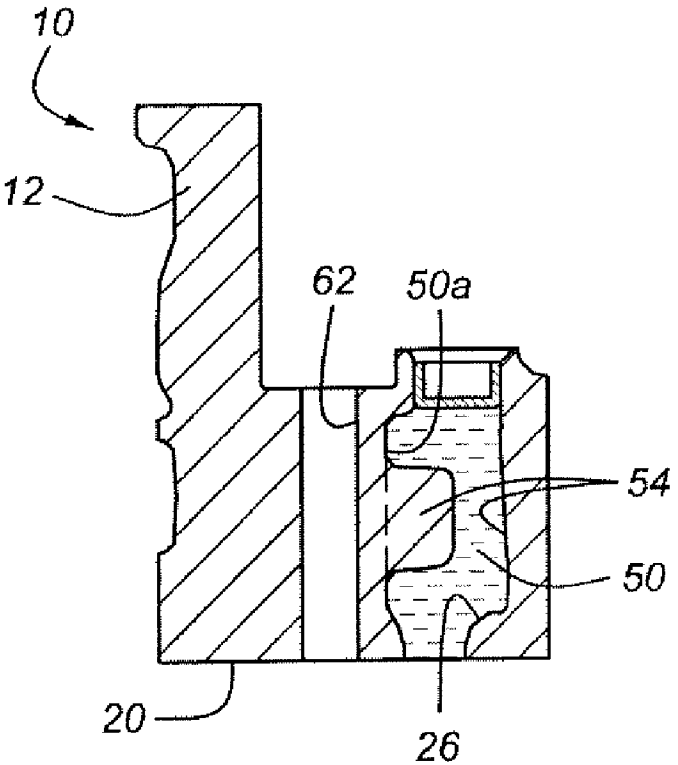
FIG. 4 is a sectional view of a portion of the cylinder head of FIG. 2, taken along the line 4-4 of FIG. 2.

FIG. 4 shows a second coolant passage 50, which is also illustrated in FIGS. 1 and 2. Second coolant passage 50 extends about a radially outboard portion of the illustrated cylinder head unit. As seen in the various figures, second coolant flow director 54 is a truncated, laterally-directed bulk flow displacer which extends from a rear wall 50*a* (FIG. 4) of second coolant passage 50. Second coolant flow director 54 is said to be a laterally-directed bulk flow displacer, because it has a bow-shaped leading edge and a wide body which serve to push the coolant flow laterally, so as to cause impingement upon the fire deck and port regions of adjacent cylinder units, including outboard portion 58 of exhaust port 34 (FIG. 2).

While particular embodiments of the invention have been shown and described, numerous variations and alternate embodiments will occur to those skilled in the art. Accordingly, it is intended that the invention be limited only in terms of the appended claims.

What is claimed is:

1. An internal combustion engine cylinder head unit, comprising:

a plurality of intake ports extending upwardly from a fire deck;

a plurality of partially conjoined exhaust ports extending upwardly from the fire deck;

a common coolant passage extending between said exhaust ports;

a first coolant flow director extending downwardly into said common coolant passage, so as to cause a coolant flow within said common coolant passage to remain attached to an upper surface of said fire deck between said exhaust ports, wherein said first coolant flow director further causes coolant to flow about an outer surface of each of said exhaust ports, so as to further cause a recirculation which promotes attachment of the coolant flow to said upper surface of said fire deck.

2. An internal combustion engine cylinder head unit according to claim 1, wherein said first coolant flow director comprises a flow splitter depending from an upper wall of said common coolant passage.

3. An internal combustion engine cylinder head unit according to claim 2, wherein said flow splitter divides at least a portion of said common coolant passage into three sub-passages.

4. An internal combustion engine cylinder head unit according to claim 1, further comprising a second coolant passage extending about a radially outboard portion of said cylinder head unit.

5. An internal combustion engine cylinder head unit according to claim 4, further comprising a second coolant flow director extending into said second coolant passage from a rear wall of said second coolant passage, so as to cause coolant flowing within said second coolant passage to impinge upon an upper surface of said fire deck, as well as upon at least an outboard portion of one of said exhaust ports.

6. An internal combustion engine cylinder head unit according to claim 5, wherein said second coolant flow director comprises a truncated, laterally-directed, bulk flow displacer.

7. An internal combustion engine cylinder head unit, comprising:

at least one intake port extending upwardly from a fire deck;

at least one exhaust port extending upwardly from the fire deck;

a common coolant passage extending between said at least one intake port and said at least one exhaust port;

a first coolant flow director extending downwardly into said common coolant passage, so as to urge a coolant flow within said common coolant passage to remain attached upon an upper surface of said fire deck between said intake port and said exhaust port, wherein said first coolant flow director comprises a flow splitter depending from an upper wall of said common coolant passage, so as to further cause coolant to flow about an outer surface of each of said at least one intake port and said at least one exhaust port; and a second coolant flow director extending into a second coolant passage running about a radially outboard portion of said cylinder head unit, with said second coolant flow director comprising a laterally-directed bulk flow displacer extending from a rear wall of said passage, so as to cause coolant flowing within said second coolant passage to impinge upon an upper surface of said fire deck, as well as at least an outboard portion of said at least one exhaust port.

8. An internal combustion engine cylinder head unit, comprising:

a plurality of gas flow ports extending upwardly from a fire deck;

a common coolant passage extending between adjacent ports comprising a portion of said plurality of gas flow ports;

a first coolant flow director comprising a flow splitter extending downwardly into said common coolant passage, so as to cause a partially recirculated coolant flow within said common coolant passage to remain attached to an upper surface of said fire deck between said adjacent ports, as well as to impinge upon an outer surface of each of said adjacent ports;

a second coolant passage running about a radially outboard portion of said cylinder head unit; and a second coolant flow director extending into said second coolant flow passage, with said second coolant flow director comprising a truncated, laterally-directed bulk flow displacer extending from a rear wall of said second coolant flow passage, with said second flow director causing coolant flowing within said second coolant passage to impinge upon an upper surface of said fire deck, as well as at least an outboard portion of at least one of said adjacent ports.

9. An internal combustion engine cylinder head unit according to claim 8, further comprising a plurality of bearing bulkheads for mounting a camshaft to the cylinder head unit.

10. An internal combustion engine cylinder head unit according to claim 8, wherein said cylinder head unit comprises two intake ports and two exhaust ports.

* * * * *